US010730097B2

(12) United States Patent
Walti et al.

(10) Patent No.: US 10,730,097 B2
(45) Date of Patent: Aug. 4, 2020

(54) METHOD AND DEVICE FOR FEEDING A SHEET METAL PANEL TO A PUNCH PRESS

(71) Applicant: Soudronic AG, Bergdietikon (CH)

(72) Inventors: Reto Walti, Widen (CH); Roland Dietschi, Mellingen (CH)

(73) Assignee: SOUDRONIC AG, Bergdietikon (CH)

( * ) Notice: Subject to any disclaimer, the term of this patent is extended or adjusted under 35 U.S.C. 154(b) by 0 days.

(21) Appl. No.: 16/098,281

(22) PCT Filed: Apr. 4, 2017

(86) PCT No.: PCT/CH2017/000033
§ 371 (c)(1),
(2) Date: Nov. 1, 2018

(87) PCT Pub. No.: WO2017/190258
PCT Pub. Date: Nov. 9, 2017

(65) Prior Publication Data

US 2019/0143391 A1 May 16, 2019

(30) Foreign Application Priority Data

May 4, 2016 (CH) ..... 591/16

(51) Int. Cl.
*B21D 43/02* (2006.01)
*B21D 28/04* (2006.01)
(Continued)

(52) U.S. Cl.
CPC ..... *B21D 43/023* (2013.01); *B21D 28/04* (2013.01); *B21D 43/02* (2013.01); *B21D 43/10* (2013.01); *B21D 43/24* (2013.01)

(58) Field of Classification Search
CPC ..... B21D 43/023; B21D 43/24; B21D 43/10; B21D 43/02; B21D 28/04
(Continued)

(56) References Cited

U.S. PATENT DOCUMENTS 3,667,334 A * 6/1972 Brunett ..... B21D 28/04 83/362
4,382,395 A * 5/1983 Haar ..... B21D 28/265 271/14

(Continued)

FOREIGN PATENT DOCUMENTS

DE 43 45 184 A1 11/1994
GB 2 211 002 A 6/1989

(Continued)

OTHER PUBLICATIONS

International Search Report for International Application No. PCT/CH2017/000033 dated Jul. 19, 2017.

*Primary Examiner* — Lynn E Schwenning
(74) *Attorney, Agent, or Firm* — McCormick, Paulding & Huber PLLC

(57) ABSTRACT

The procedure followed for aligning a metal sheet in the correct position for inserting it into a punch press is that the aligned position in the feed direction is adjusted by means of stops. The alignment in the second direction orthogonal to the feed direction is such that the position of the metal sheet in the second direction is determined by a sensor and a control unit, and the deviation of the metal sheet from the predetermined aligned position in the second direction from the control unit is determined. Next, the alignment in the second direction is controlled by means of the gripping arrangement which is provided for the feed of the metal sheet to the punch press by controlling the gripping arrangement in such a way that the deviation is compensated and the metal sheet is aligned correctly.

16 Claims, 5 Drawing Sheets

(51) Int. Cl.
*B21D 43/10* (2006.01)
*B21D 43/24* (2006.01)

(58) Field of Classification Search
USPC ..... 414/783
See application file for complete search history.

(56) References Cited

U.S. PATENT DOCUMENTS 4,690,021 A * 9/1987 Clark ..... B21D 28/12 271/223
5,005,394 A * 4/1991 Sartorio ..... B21D 5/004 72/18.1
5,058,406 A * 10/1991 Sartorio ..... B21D 5/0281 72/16.2
5,182,936 A * 2/1993 Sartorio ..... B21D 5/0281 72/420
5,187,958 A * 2/1993 Prunotto ..... B21D 5/002 72/16.2
5,761,940 A 6/1998 Moore, Jr. et al.
5,950,479 A 9/1999 Kutschker
5,950,484 A * 9/1999 Kutschker ..... B21D 43/10 72/17.3
5,990,650 A * 11/1999 Brock ..... G03F 9/7011 108/146
6,185,974 B1 * 2/2001 Venturini ..... B21D 5/04 72/294
6,341,243 B1 * 1/2002 Bourne ..... G05B 19/4069 700/165
7,003,866 B2 * 2/2006 Makitalo ..... B21D 43/003 29/33 P
2012/0009051 A1 * 1/2012 Ruth ..... B65G 47/22 414/783
2015/0146218 A1 5/2015 Kerscher

FOREIGN PATENT DOCUMENTS

JP H06-31345 A 2/1994
WO 91/09696 A1 7/1991

* cited by examiner

Fig. 1 Prior Art
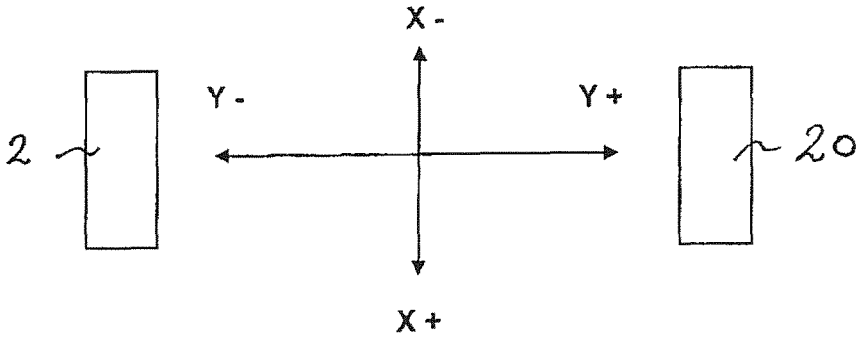
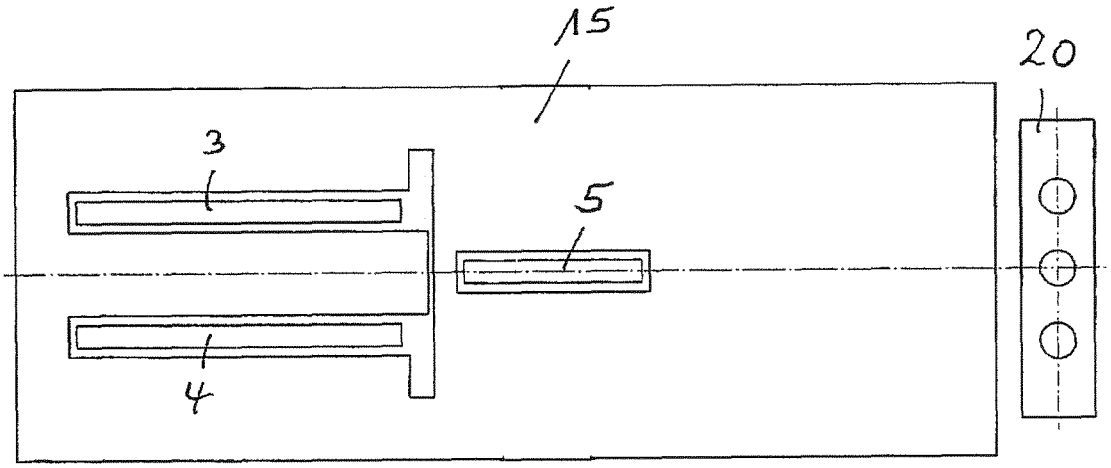
Fig. 2 Prior Art
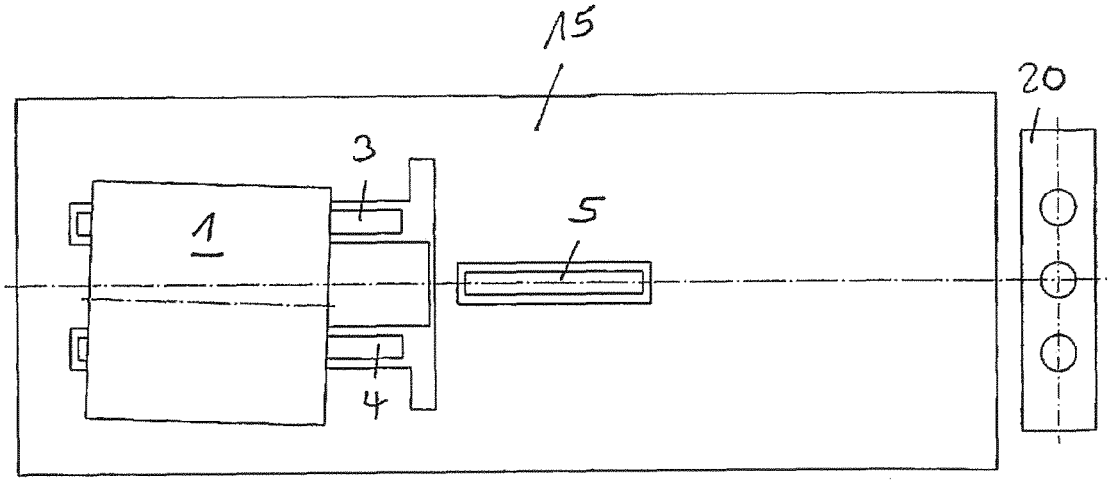
Fig. 3 Prior Art Fig. 11
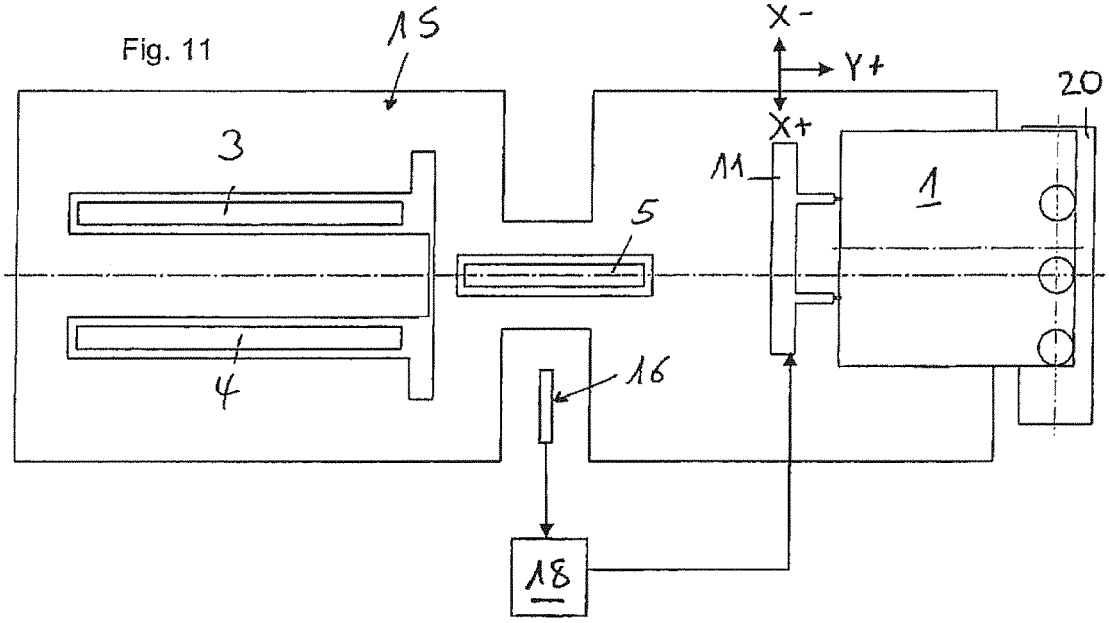
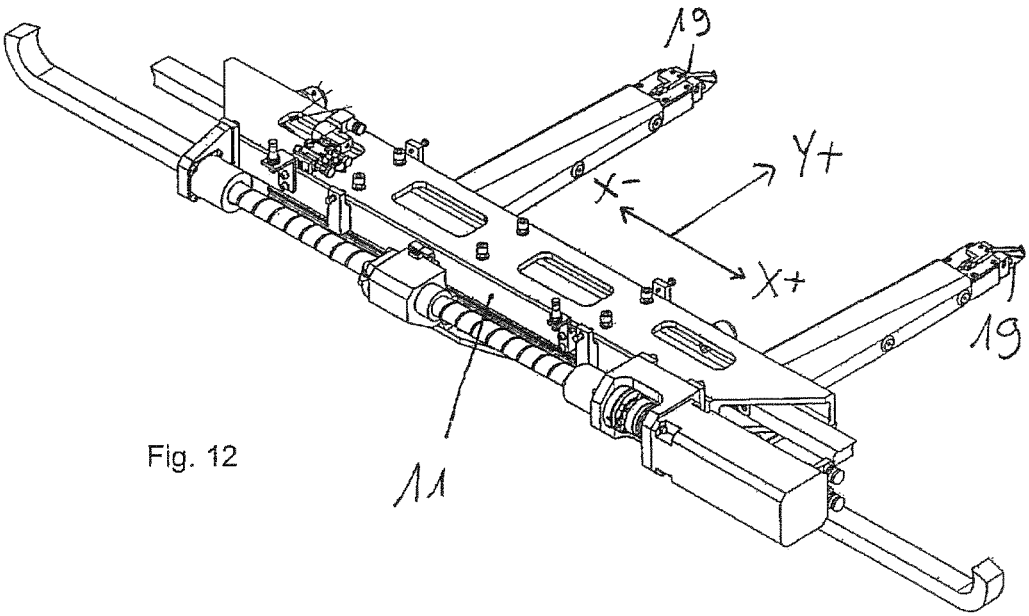
Fig. 12

METHOD AND DEVICE FOR FEEDING A SHEET METAL PANEL TO A PUNCH PRESS

CROSS REFERENCES TO RELATED APPLICATIONS

This application is a National Stage application of International Patent Application No. PCT/CH2017/000033 filed Apr. 4, 2017, which claims priority to Swiss patent application No. 00591/16, filed May 4, 2016, each of which is hereby incorporated by reference in its entirety.

FIELD OF THE INVENTION

The invention relates to a method for aligning a metal sheet in feeding the metal sheet to a processing station, in particular to a punch press, wherein the feed toward and into the processing station takes place in a first direction (Y axis) of two orthogonal directions (X axis and Y axis), wherein the alignment of the metal sheet takes place by a first alignment step in the first direction (Y axis) and, in a second alignment step, the alignment takes place in the second direction (X axis), in order to achieve a predetermined aligned position of the metal sheet, and wherein, for feeding the metal sheet, the sheet is gripped by a gripper arrangement, conveyed toward the processing station and introduced into the processing station, where it is punched to produce the desired processing pattern, in particular a punch pattern, and where it is preferably additionally conveyed back and forth in the second direction. Furthermore, the invention also relates to a device for carrying out the method and a system for producing punched parts using such a device.

BACKGROUND OF THE INVENTION

In the metal packaging industry today, can lids or deep-drawn cans made of steel or aluminum, in round or non-round shape, are often produced on high-performance systems. For reasons of productivity, portal presses are used, enabling the use of multiple tools. Depending on the type of press and the available pressing force, tools in a "zigzag" or linear arrangement are used. With each press stroke, several components are thus produced at the same time. The basic material—whether made of aluminum or steel—is processed in the press in the form of metal sheets. By means of one or more gripper systems or rollers, the metal sheets are fed to the tools and then processed step by step. Depending on the type of tool and the feed system, the sheets are moved only in the Y direction or in the X and Y directions in an orthogonal coordinate system. Again, sheets as large as possible are processed for reasons of productivity. When larger sheets are used, there are fewer sheets that must be lacquered, cut, fed, etc. In any case, however, the metal sheets must be brought into each punch position with a high precision.

The metal sheets are fed to the system in the form of a stack. Several thousand metal sheets may be stacked in a stack. Weight usually limits the height of the stack. The stacks are placed on a chain conveyor or a roller conveyor and then conveyed either in the production direction of the metal sheet processing in the press or in a direction 90° to the production direction into the stacking and destacking position. An electrically or hydraulically driven lift system lifts the stack up to a vertical position, in which the metal sheets are gripped individually and fed in the direction of the sheet press.

Because of the great weight of the stack (usually several tons), the stacks can be guided into the destacking position only with a relatively great inaccuracy. Consequently, the destacking position may vary as much as a few centimeters from one stack to the next. Furthermore, the stacks often have stacking errors. The metal sheets may be displaced (fanned out) either in the stacking operation in the coil cutting system or in the lacquering system or during conveyance to the processing system. Modern destacking systems today must be capable of compensating for such errors. However, more accurate centering of the stack would require complex and expensive mechanisms. Furthermore, the process of destacking each individual sheet by using suction grippers is also relatively inaccurate. When the metal sheets are gripped and conveyed in the direction of the sheet press, the sheets may as well be oiled. Rollers, which can cause additional inaccuracies in the lateral position of the sheets, are generally used for this oiling process.

Before a metal sheet fed to the punch press can be processed in the pressing tool, it must thus be brought into a defined precise position by an aligning arrangement. This is true in the feed direction to the punch press as well as in the direction perpendicular thereto. The precision must be in the range of ±0.2 mm. One reason for this is that the various punch positions in the metal sheet should be as close together as possible, so that maximum utilization of material of the metal sheet is achieved. Additional reasons may include the fact that the sheets may be lithographed (printed) and the punching must correspond precisely to the printing or that the residual web width at the edge of the sheet should be kept very small. This is an important criterion in processing metal sheets on a sheet press with a multiple tool to achieve a high productivity.

FIG. 1 shows mutually perpendicular X and Y axes, used to describe how the respective metal sheets are fed to the punch press and how the metal sheets are centered and to explain the prior art as well as explain the present invention. The destacker 2 and the press 20 are also shown schematically in FIG. 1. The metal sheets are centered in X and Y directions according to the prior art, for example, as shown schematically in FIGS. 2 through 6. A metal sheet removed from the sheet metal stack is aligned on a centering table 15, which has conveyor belts 3, 4 and 5. FIG. 3 shows that a metal sheet 1 removed from the sheet metal stack (not shown) by the destacker 2 has been deposited on the centering table. The metal sheet is conveyed by means of the conveyor belts 3, 4 and 5 on the centering table 15 in a positive Y direction (Y+ direction), which is defined as the direction toward the press 20. FIG. 4 shows the sheet 1 in a position in which it has been advanced in the Y+ direction far enough that the sheet 1 rests only on the conveyor belt 5. This is a return position from which the sheet 1 is moved by the conveyor belt 5 in the negative Y direction (Y−) for centering and/or alignment, i.e., it is moved a short distance again towards the destacker 2. FIG. 5 shows how the metal sheet 1 is in contact with two stops 6 and 7 after being conveyed with the conveyor belt 5 in the Y− direction, the stops having been raised above the level of the table for this purpose. The sheet is thus centered, i.e., aligned in the Y axis. Then a stop 8 is positioned close to the sheet in the X+ direction and finally a slide and/or another stop 9 moves the sheet in the negative X direction (X−) toward the stop 8, so that it reaches the centered and/or aligned position of the metal sheet 1 according to FIG. 6. The alignment in X and Y directions can be combined with another embodiment according to the prior art, for example, by the fact that a spring-mounted vacuum gripper system moves the sheets in the direction of a stop X+ and Y−.

DE 43 45 184 A1 discloses a centering mechanism by which a centering station, referred to here as an alignment station, for metal sheets is designed with two lateral stops and a rear stop for the metal sheets.

As soon as a metal sheet has reached its definitive orientation and position and/or is aligned correctly, it is taken over by a handling system and conveyed for processing in the tool 20. FIG. 6 therefore shows a gripper 11, which grips the sheet 1 in its previously centered/aligned position at its rear end and feeds it in the direction Y+ to the press 20. The gripper, which shifts the sheet metal in the Y+ direction, and optionally moves it in the X− and X+ directions to achieve the desired punch pattern, may be the same gripper which has gripped the centered sheet 1 in the position shown in FIG. 6. It is known that a second gripper may be present to receive the sheet 1 from the first gripper upstream from the press 20.

The alignment and/or centering mechanism according to the prior art, as explained here, is complex and requires high maintenance. Furthermore, this mechanism needs a certain amount of time in order to align the sheets. During the centering and/or alignment operations, the handling system and/or the gripper cannot yet receive the metal sheet—first, because the alignment is not yet completed, and second, because the alignment mechanism could cause a collision with the gripper.

SUMMARY

The object of the invention is to provide an improved method for alignment of a metal sheet upon feeding the metal sheet to a processing station. In particular, a reduced need for maintenance and a more rapid conveyance to the press are to be made possible with this invention.

This object is achieved for the method defined in the introduction by that the alignment of the metal sheet in the second direction (X axis) is done by the following steps:

- determining the position of the metal sheet in the second direction (X axis) by at least one sensor means;
- detecting the deviation of the metal sheet from its predetermined aligned position in the second direction by analyzing the sensor signals using a control unit; and
- correcting the deviation of the aligned position from the predetermined aligned position in the second direction (X axis) after gripping of the metal sheet by means of the gripping arrangement, in that the gripping arrangement provides, in a process controlled by the control unit, the movement of the metal sheet into the predetermined aligned position in the second direction during the feed movement of the metal sheet to the processing station.

The subject matter of the invention is thus to omit the sheet metal displacement in the X axis or the second direction, respectively, as a separate alignment step. Instead, the position of the sheet in the X axis is detected by at least one sensor, preferably in a noncontact detection operation, so that this position can be detected in a control unit connected to the sensor. Thus, instead of bringing the sheet first into a defined X position and then transferring the sheet to the gripper arrangement, first only the X position of the metal sheet is detected. The control unit calculates the taking over position for the gripper arrangement on the basis of the values thereby obtained and the gripper arrangement brings the metal sheet into the correct position with respect to the X axis or, in other words, compensates for the deviation found by the sensor device and the control unit from the predetermined aligned position in the second direction upon feeding the metal sheet to the processing station. Therefore, no alignment parts for the alignment in the X axis must be adjusted or maintained.

The advantage of this procedure is thus, on the one hand, the elimination of the complex and high-maintenance alignment mechanism. On the other hand, the time required for this mechanism to align the sheet is also omitted.

Before the sheet is gripped, the position of the gripper arrangement is preferably adapted to the deviating position of the sheet in the X direction by displacing the gripper arrangement accordingly. Thus, the sheet is gripped in the position on the metal sheet provided for this purpose.

The position of the sheet in the second direction is preferably determined by a stationary sensor, which yields a simple and robust design. Alternatively or additionally the position may be determined in the second direction by a movable sensor, in particular by arranging a sensor on the gripper arrangement and having the latter move the sensor over the metal sheet. In this way, it is possible to use a movable sensor, which can simplify the design of the sensor that is used without requiring any additional mechanism for the movement of the sensor.

In particular, a line sensor with or without a reflector or a camera with image processing may be used as the sensor for the sensor means. The sensor may be arranged above or beneath the position of the metal sheet or a sensor may be provided both above and beneath the position of the metal sheet. Multiple sensors in all the variants described here can improve the detection of the position, in particular with the preferred use of optical sensors of the sensor means because the metal sheets may have different reflection properties depending on the material and the pretreatment. Instead of noncontact optical sensor means, however, sensor means that operate by touch may also be used.

The present invention is additionally based on the object of creating an improved device for alignment of a metal sheet in feeding the metal sheets to a processing station, in particular to a punch press. In particular, a lower need for maintenance and a more rapid feed to the processing station and/or press should be made possible with this device.

This object is achieved with a device having a gripping arrangement gripping the metal sheet and moving the metal sheet into a predetermined position aligned with the processing station.

The subject matter of the invention is thus also to avoid by this device the displacement of the metal sheet in the X axis or in the second direction, respectively, as a separate alignment and instead to make the position of the sheet in the X axis detectable by at least one sensor so that this position can be determined in a control unit connected to the sensor. Thus, instead of bringing the sheet first into a defined X position and transferring the sheet then and only then to the gripper arrangement, this makes it possible for the device to first detect only the X position of the metal sheet. The control unit then calculates the taking over position for the gripper arrangement on the basis of the values thereby obtained, and the gripper arrangement brings the metal sheet into the correct position with respect to the X axis upon feeding the metal sheet to the processing station. Thus, no alignment parts for alignment in the X axis need to be adjusted and maintained with this device.

Thus, on the one hand, the advantage of this device is to eliminate the complex and high-maintenance alignment mechanism, but on the other hand, the time required by this mechanism to align the sheets is also eliminated.

It is preferable to provide a stationary sensor for determining the position in the second direction, which yields a particularly robust and maintenance-free device. It is also possible to provide a movable sensor of the sensor means for determining the position in the second direction, in particular it is possible for the sensor of the sensor means to be arranged on the gripper arrangement and to be movable by means of this configuration over the metal sheet, which has the advantage that it is not necessary to use any additional mechanism for the movement of the sensor because the gripper arrangement is designed anyway for carrying out the required movement.

In particular a line sensor with or without a reflector may be provided as the sensor or a camera with image processing may be provided as the sensor. Furthermore, the sensor means may also include sensors arranged above or below the position of the metal sheet. These measures and/or types and arrangements of sensors can improve the detection of the edges of the metal sheet in an industrial environment. In particular it may therefore be advantageous to provide sensor means having a plurality of different sensors for detecting the position of the metal sheets.

In addition, the invention is based on the object of providing an improved system for producing punched parts for metal sheets.

This object is achieved with a system having a sheet metal destacker, a punch press and a device for aligning the metal sheets with the punch press while feeding the metal sheets to the punch press.

Thus, with this invention in all its embodiments, the procedure followed in feeding a metal sheet to a punch press for alignment of the metal sheet in the correct position for inserting the metal sheet into the punch press, is such that the aligned position is adjusted by means of stops in the feed direction. The alignment in the second direction orthogonal to the feed direction is accomplished in such a way that the position of the metal sheet in the second direction is determined by at least one sensor and a control unit, and the deviation of the metal sheet from the predetermined aligned position in the second direction is determined by the control unit. Then the alignment in the second direction is accomplished by means of the gripper arrangement, which is present for feeding the metal sheet to the punch press, in that the gripper arrangement is controlled in such a way that the deviation is compensated and the metal sheet is aligned correctly.

BRIEF DESCRIPTION OF THE DRAWINGS

Additional embodiments, advantages and applications of the invention are derived from the dependent claims and from the description which now follows with reference to the figures, in which:

FIG. 1 shows schematically a destacker and a punch press as well as a coordinate system to illustrate the feed of a metal sheet from the destacker to the punch press in both the prior art and in a procedure according to the invention;

FIGS. 2 through 6 show a procedure according to the prior art;

FIGS. 7 through 11 show a procedure and a device according to one exemplary embodiment of the invention; and FIG. 12 shows an example of a gripper of the gripper arrangement.

DESCRIPTION OF THE PREFERRED EMBODIMENTS

To illustrate an exemplary embodiment of the invention, reference is also made to the coordinate system according to FIG. 1. The prior art has already been explained with reference to FIGS. 2 through 6, to which reference is made here.

Figure 4:
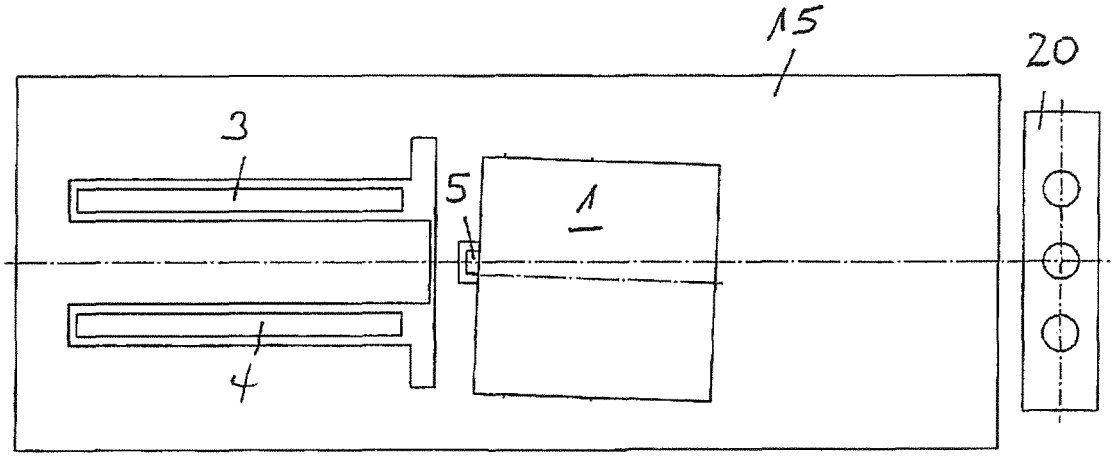
Fig. 4 Prior Art
Figure 5:
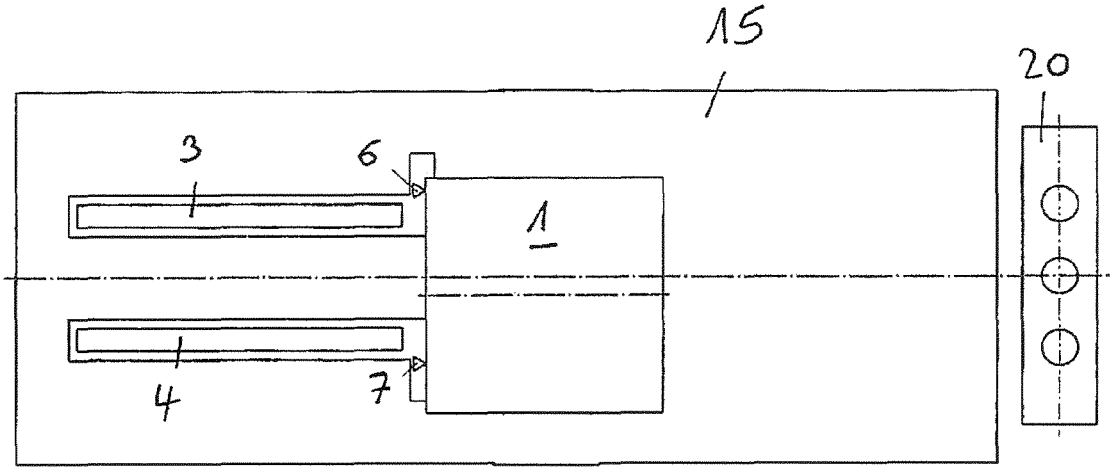
Fig. 5 Prior Art
Figure 6:
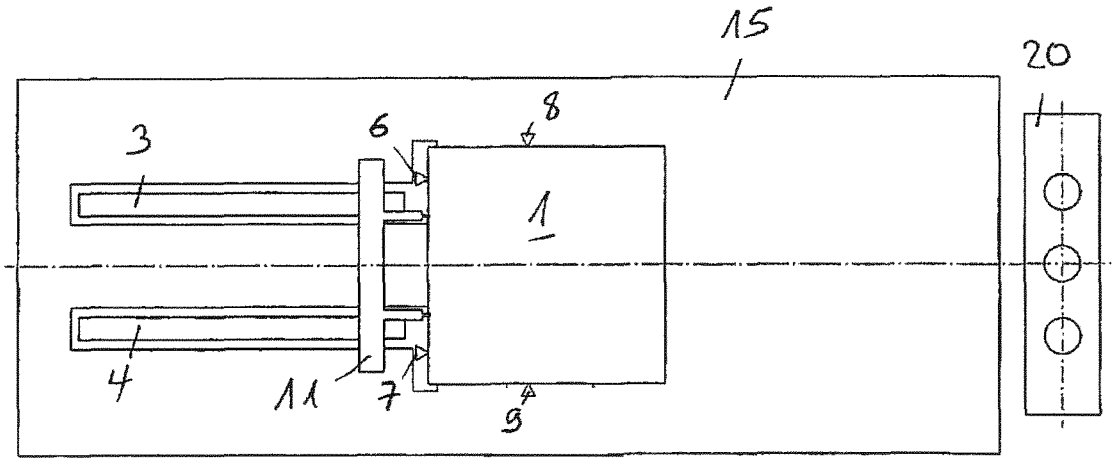
Fig. 6 Prior Art
Figure 7:
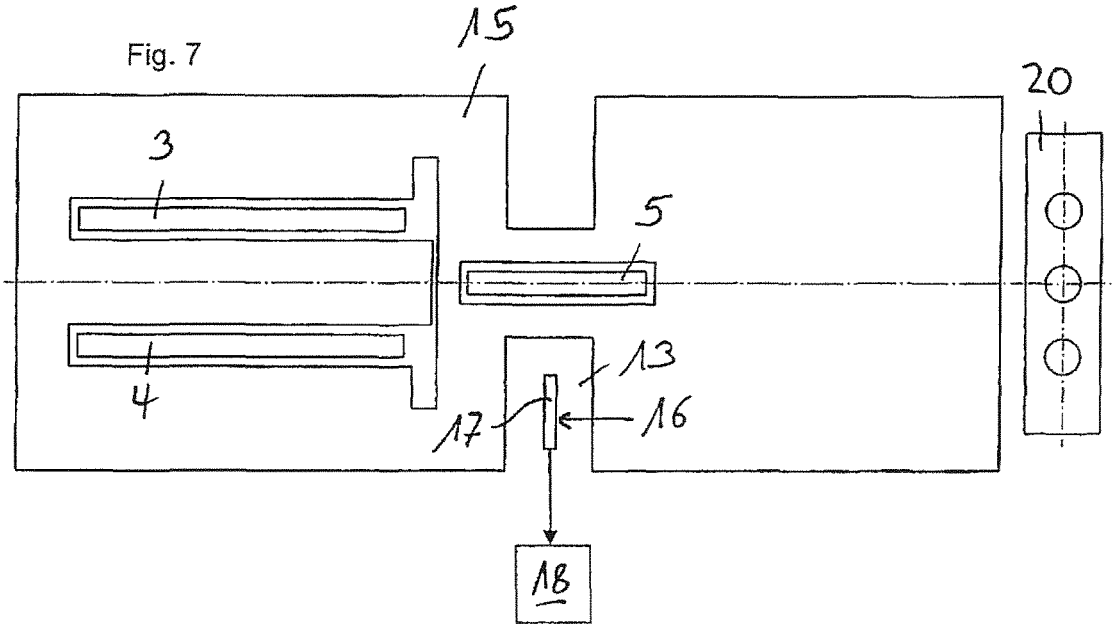

FIG. 7 shows a centering table 15 of one exemplary embodiment of the invention in which a sensor means 16 is provided with at least one sensor and as the case may be any illumination means and/or reflectors, said sensor means being able to detect the position of the edge of a metal sheet, which comes to lie on the table within the detection range of the sensor means, and detect the position of the edge in the X coordinate, which will be explained further below. Thus, together with a control unit 18 which receives the signal of the sensor means 16, the position of the metal sheet can be detected in the X coordinate and/or the deviation of the metal sheet 1 from the desired predetermined aligned position in the X coordinate. FIG. 7 as well as FIGS. 8 and 9 do not show the gripper arrangement in order to simplify the figures. However, a gripper arrangement is present and will be explained later with reference to FIGS. 10, 11 and 12. FIG. 7 also shows conveyor belts 3, 4 and 5 by means of which the respective metal sheet 1 can be moved back and forth on the centering table in the Y coordinate direction. Instead of or in addition to conveyor belts, other means may also be provided for this movement, for example, rollers partially countersunk in the table. The table 15 may be provided with means for facilitating the movement of metal sheets on the table in a known manner, for example, with roller bodies arranged in a regular placement or with means for producing air cushions. The skilled person will be aware of such means which will not be discussed further here.

Figure 8:
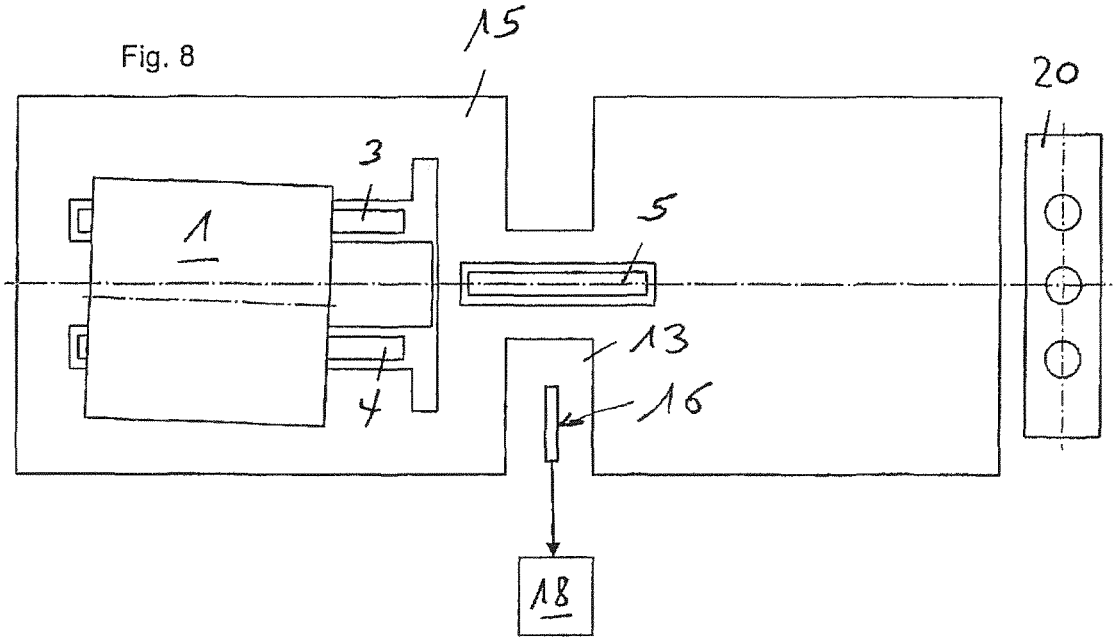
Figure 9:
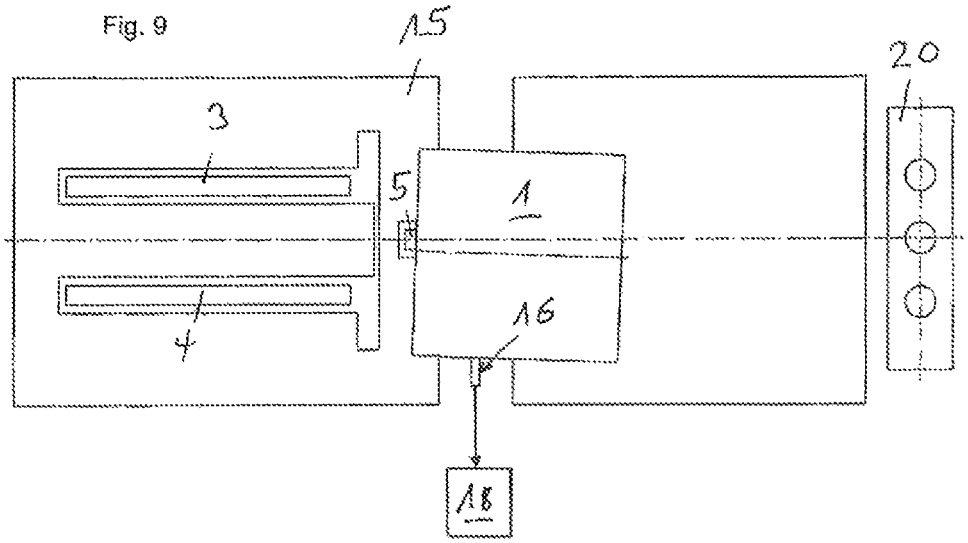

FIG. 8 shows a metal sheet 1 which has been deposited on the centering table and first on the conveyor belts 3 and 4. By means of the conveyor belts 3, 4 and 5, the metal sheet is aligned in the Y direction by shifting the metal sheet 1 first in the Y+ direction. Once the metal sheet has reached a position in which it sits only on the conveyor belt 5 as shown in FIG. 9, it is displaced in the Y− (Yminus) direction toward the two stops 6 and 7, as explained already in the prior art, and as shown here in FIG. 10. This is the preferred type of alignment in the Y direction. Other known types of alignment in the Y direction may also be used.

In the figures in the exemplary embodiment, the sensor means 16 comprise at least one stationary sensor 17 with a longitudinal extent in the X coordinate direction. This sensor is, for example, a line sensor having a plurality of light-sensitive sensor elements arranged in a row and thus capable of emitting a signal which can determine the position of an object above the sensor, by detecting which sensor elements are darkened by the object and which sensor elements are not darkened. In this example, such a sensor is arranged in a recess 13 in the tabletop, so that it comes to lie beneath the metal sheet 1. Furthermore, it is arranged in such a way that, with the metal sheet 1 aligned in the Y coordinate, the position of the edge 1' in the X coordinate can be emitted as a sensor signal via the sensor. It can be seen in FIG. 10 that the edge 1' of the metal sheet 1 lies above the sensor so that a portion 17' of the sensor is covered by the metal sheet 1. The portion of the sensor of the sensor means which lies in the X+ direction and is not covered by the metal sheet 1 is labeled as 17". The sensor is connected to a control unit 18 which analyzes the sensor signal and thus can calculate the deviation of the position of the metal sheet 1 in the X coordinate from the desired aligned position of the metal sheet. This control unit also controls the drive of the gripper 11 in the gripper arrangement. The precise position of the metal sheet by the sensor means can be detected by means of just one sensor, for example, using the abovementioned line sensor, and with or without illumination means and/or reflectors, or the sensor means may include multiple sensors whose signals are analyzed in the control unit. The sensor means may also include an optical system, for example, a camera with image processing, which is used in addition to a sensor or instead of a sensor. Sensors or cameras of the sensor means may be arranged above the metal sheet position and/or beneath the metal sheet position as illustrated in this example. For reasons of precision, multiple detections may be performed. This position of the metal sheet can be detected on one edge or the other of the metal sheet and/or in the case of scrolled sheets having two edges on each side that can be scanned, this may be carried out on both edges of one side or on both edges of one or both sides.

Figure 10:
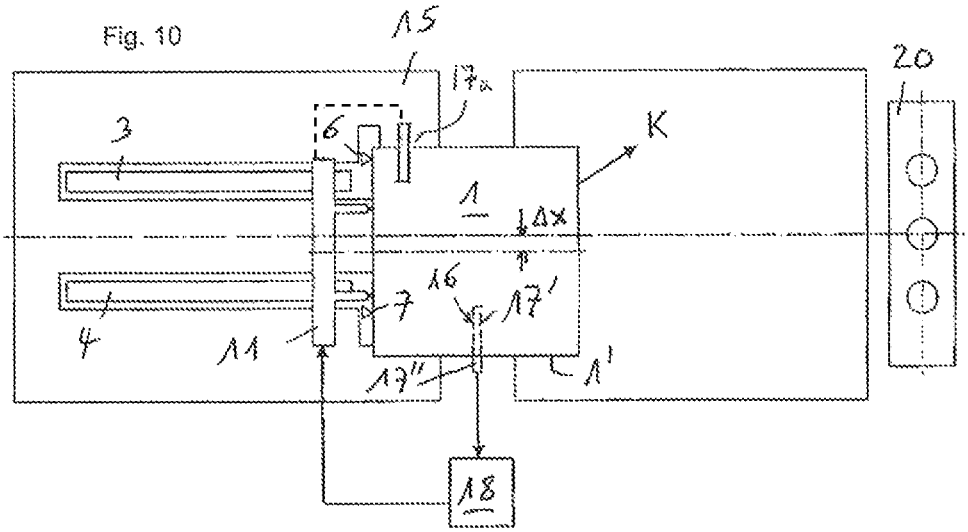

The sensor means may also include detection of the sheet metal edge by means of at least one movable sensor instead of at least one stationary sensor or in addition to a stationary sensor. For example, as shown in FIG. 10, a sensor 17*a* of the sensor means may be arranged on the gripper 11 and, for determination of the position of the metal sheet, the gripper 11 is moved over the metal sheet in such a way that its position in the X coordinate is determined. Since the control unit is usually adapted to know the position of the gripper of the gripper arrangement, it may also in this case derive the position of the metal sheet from the sensor signal. In this case, it is possible to omit a line sensor and a simpler sensor may be used.

At any rate, the sensor means may also comprise a sensor that is movable separately from the gripper. For example, a movable proximity switch may be provided. In this case detection of the sheet metal edge may take place by means of a time calculation. Since the starting position of the sensor is known and the rate of movement of the sensor is known, the time at which the sensor detects the edge of the sheet metal can be determined. An accurate position can be deduced from this time. However, to eliminate maintenance, sensor means which operate with a stationary sensor or with a stationary camera or with a movable sensor arranged on the gripper or with a camera arranged on the gripper are preferred.

Due to the determination of the position of the metal sheet in the second direction (X axis) by the sensor means 16 and detection of the deviation of the metal sheet from its predetermined aligned position in the second direction by analysis of the sensor signal by the control unit, the deviation can be corrected subsequently in feeding and/or transporting the metal sheet to the press. FIG. 10 shows that a deviation ΔX in the position of the metal sheet in the X coordinate from the desired alignment and/or centering has been determined by the sensor 17 of the sensor means and by the control unit 18. This deviation is then corrected by the gripper arrangement.

The correction of the deviation of the aligned position from the predetermined aligned position in the second direction (X axis) takes place after the metal sheet has been gripped by means of the gripping arrangement in that the gripping arrangement executes the movement of the metal sheet into the predetermined aligned position in the second direction during the feed movement of the metal sheet to the processing station, controlled by the control unit. This may take place in such a way that the gripper arrangement with the gripper 11, which is known to be movable by the control unit in X and Y directions, can be moved by means of corresponding drives of the gripper, first executes a movement in the X− (Xminus) direction to correct the amount ΔX and then executes the movement toward the press 20 in the direction Y+. However, a combined X and Y movement of the gripper 11 is preferred so that it is moved in the direction of the arrow K wherein the movement in the direction X− takes place only as long as the deviation ΔX has been eliminated.

It is preferable for the location of the gripper arrangement to be adapted to the recognized location of the sheet, which deviates in the second direction before the gripping of the sheet by displacing the gripper arrangement accordingly in two directions in order to provide the gripping of the sheet in the location on the sheet provided for this purpose. This is shown in FIG. 10 by the fact that the gripper 11 of the gripper arrangement is also displaced essentially by the amount ΔX in the second direction, likewise before the gripping, in order to grip the sheet 1 at the location provided for this purpose.

Then the gripper 11 brings the metal sheet into the press 20 and carries out the known punching movement in X and Y directions, as shown in FIG. 11. The gripper arrangement may also have two grippers in a known way with the metal sheet 1 aligned by the first gripper being transferred between them. The gripper 11 in FIG. 10 then carries out the correction movement in the X direction and the Y movement toward the punch press and carries out all the punching actions on at least one row of the punch pattern (usually two or three punch rows), after which a second gripper of the gripper arrangement takes up the metal sheet and performs the punching action while the first gripper is returned back to the point of transfer of the following metal sheet.

FIG. 12 shows a known gripper of the gripping arrangement such as it is already used in traditional devices and as it is also used for the present invention. The gripper 11 can be moved by corresponding drives in the X direction and in the Y direction, where these drives are controlled by the control unit. The gripper has two tongs 19, by means of which the metal sheet can be gripped at its rear edge as seen in the Y+ direction and can then be released again. This is known and will not be discussed further here.

Although preferred embodiments of the invention are described in the present patent application, it should be pointed out clearly that the invention is not limited to them and can also be carried out in another way within the scope of the following claims.

What is claimed is:

1. A method for aligning a metal sheet upon feeding the metal sheet to a processing station, wherein the feed takes place in a first direction (Y axis) of two orthogonal directions (X axis and Y axis), wherein in a first alignment step, the alignment of the metal sheet takes place in the first direction (Y axis) and in a second step the alignment takes place in the second direction (X axis) to achieve a predetermined aligned position of the metal sheet, and wherein for feeding the metal sheet is gripped by a gripper arrangement and is moved towards the processing station and introduced into the processing station and is additionally moved back and forth in the second direction for achieving the desired processing pattern, wherein the alignment of the metal sheet in the second direction (X axis) is provided by the following steps:

determining the position of the metal sheet in the second direction (X axis) by a sensor means;

detecting the deviation of the metal sheet from its predetermined aligned position in the second direction by analyzing the sensor signal by a control unit;

adapting the position of the gripping arrangement to the detected position of the sheet to eliminate the detected deviation by displacing the gripping arrangement in the second direction according to the deviation and the detected position of the sheet before gripping of the sheet at the sheet's determined position for movement in the second direction; and correcting the deviation of the aligned position from the predetermined aligned position in the second direction (X axis) after gripping the metal sheet by means of the gripping arrangement, in that the gripping arrangement, controlled by the control unit, performs the movement of the metal sheet into the predetermined aligned position in the second direction in combination with the feed movement of the metal sheet to the processing station.

2. The method according to claim 1, wherein the step of determining the position of the metal sheet in the second direction is determined by a stationary sensor of the sensor means.

3. The method according to claim 1, wherein the step of determining the position of the metal sheet in the second direction is determined by a movable sensor of the sensor means.

4. The method according to claim 3, wherein the movable sensor is arranged on the gripping arrangement and is moved by the gripping arrangement over the metal sheet.

5. The method according to claim 1, wherein a line sensor with or without a reflector is a sensor of the sensor means and/or a camera with image processing is a sensor of the sensor means.

6. The method according to claim 1, wherein a sensor of the sensor means is arranged above or below the position of the metal sheet or a sensor of the sensor means is provided both above and below the position of the metal sheet.

7. The method according to claim 1, wherein the position of the metal sheet is detected on one edge or on the other edge of the metal sheet which lies in the X direction.

8. The method according to claim 1, wherein the position of the metal sheet position is detected by several different optical sensors of the sensor means.

9. A device for alignment of a metal sheet upon feeding the metal sheet to a processing station comprising: a control unit and a gripping arrangement with at least one gripper, said gripping arrangement being provided to implement feeding of the metal sheet, under control by the control unit, to the processing station, in a first direction (Y axis) of two orthogonal directions (X axis and Y axis), and being additionally provided for the movement of the metal sheet in the second direction; sensor means connected to the control unit and producing a sensor signal indicating the position of the metal sheet in the second direction (X axis), and the control unit being adapted to determine from the sensor signal the deviation of the metal sheet from a predetermined aligned position in the second direction, and cause the gripping arrangement to be displaced in the second coordinate direction before gripping the metal sheet to compensate for any deviation of the metal sheet from the predetermined aligned position, and then grip the metal sheet and execute movement of the metal sheet into the predetermined aligned position in the second direction during the feeding movement of the metal sheet to the processing station.

10. The device according to claim 9, wherein the sensor means for determining the position in the second direction is a stationary sensor.

11. The device according to claim 9, wherein the sensor means is a movable sensor for determining the location in the second direction.

12. The device according to claim 11, wherein the movable sensor of the sensor means is arranged on the gripping arrangement and can be moved by it over the metal sheet.

13. The device according to claim 9, wherein the sensor means is a line sensor with or without a reflector, or a camera with image processing.

14. The device according to claim 9, wherein the sensor of the sensor means is arranged above or below the metal sheet position, or the sensor means is comprised of sensors above and below the metal sheet position.

15. The device according to claim 9, wherein sensor means has a plurality of different sensors for detecting the metal sheet position.

16. A system for producing punched parts from metal sheets, the system including a destacker for destacking individual metal sheets from a stack, a punch press for forming the punched parts from the respective metal sheet and having a device according to claim 9 for aligning the respective metal sheets upon feeding them to the punch press.

* * * * *